United States Patent [19]

Schatzmann

[11] 3,950,809

[45] Apr. 20, 1976

[54] COMBINATION SWEEPER AND VACUUM CLEANER FOR SWIMMING POOLS

[76] Inventor: Rudolf Emil Schatzmann, 1502 Longmont Place, Santa Ana, Calif. 92705

[22] Filed: Nov. 8, 1974

[21] Appl. No.: 522,031

[52] U.S. Cl. ..... 15/1.7; 15/41 A; 15/385

[51] Int. Cl.[2] ..... E04H 3/20

[58] Field of Search ..... 15/1.7, 41 A, 384

[56] References Cited

UNITED STATES PATENTS

| | | | |
|---|---|---|---|
| 3,273,187 | 9/1966 | Williams | 15/1.7 |
| 3,337,889 | 8/1967 | West | 15/1.7 |

FOREIGN PATENTS OR APPLICATIONS

| | | | |
|---|---|---|---|
| 1,903,416 | 8/1970 | Germany | 15/384 |
| 1,923,908 | 11/1970 | Germany | 15/41 A |
| 623,790 | 4/1949 | United Kingdom | 15/41 A |
| 1,152,277 | 5/1969 | United Kingdom | 15/1.7 |

*Primary Examiner*—Edward L. Roberts

[57] ABSTRACT

A combination pool sweeper and vacuum cleaner is provided with a plurality of ride wheels and a pair of endless rubber tracks for movably supporting a suction chamber defining housing adjacent the pool surface to be cleaned. The suction chamber housing is provided with a bail for the attachment of a control handle for guiding the tool over the surface to be cleaned. A pair of counter-rotating brushes are driven from one of the endless rubber tracks through a gear train. A portion of this gear train, along with the suspension bearings of the rubber track, is mounted in a reciprocable bracket and includes a pair of pinions which alternately, depending on the direction of motion of the tool, engage drive gears attached to the shafts of the rotary brushes, ensuring that rotation of both brushes is always in the direction of the suction chamber of the combination tool irrespective of the direction in which the tool moves.

2 Claims, 6 Drawing Figures

COMBINATION SWEEPER AND VACUUM CLEANER FOR SWIMMING POOLS

BACKGROUND OF THE INVENTION

1. Field of the Invention

Combination sweeper and vacuum cleaner for swimming pools.

2. Description of the Prior Art

This invention relates to a tool for concurrently sweeping and vacuuming a pool to remove foreign solid material therefrom.

In the prior art many tools for the cleaning of swimming pools have been proposed. Most of these devices of the prior art are distinguishable into sweepers for the collection of debris, dust and refuse accumulated on the underwater surfaces of the pool; and into vacuum heads for the removal of the collected contaminants.

Attempts at combination tools have been unsuccessful since the operation of the sweeping devices included therein tended, at least under some operating conditions, to move accumulated debris away from the vacuum pick-up chamber, rather than into it.

It is, therefore, the primary object of the instant invention to disclose the construction and use of a novel pool cleaning tool wherein the functions of the pool sweeper and the pool vacuum are combined into a compact highly efficient unit.

It is further object of the invention to provide in such a tool sweeping brushes of a rotary type whose action propels accumulated debris into the vacuum chamber of the tool regardless of the direction of travel of the tool.

It is another object of the invention to provide means in a tool of the character described for the rotation of such brushes that are illustrated as a gear train connected to endless track belts in the base of the tool.

It is also an object of the invention to provide a combination tool for the collection and removal of solid matter from swimming pool surfaces which is simple to manufacture and easy to use.

SUMMARY OF THE INVENTION

The invention attains its objects by providing a vacuum chamber connected to the suction side of a suitable pump; the chamber being downwardly open and supported, in a predetermined elevation above the surface to be cleaned, on a pair of endless track belts and a plurality of guide wheels or rollers. The track belts and guide wheels or rollers define an axis of travel along which the cleaning tool may be reciprocated by a handle attached to the outer surface of the vacuum chamber.

A pair of rotary sweeping brushes are transversely mounted in the vacuum chamber of the tool and are driven by a gear train whose motion is derived from the motion of one, or both, of the aforementioned track belts.

Preferably the brush motion is derived from only one of the track belts. A bearing bracket, supporting the pulleys over which that belt is stretched, is reciprocably mounted relative to the vacuum chamber and the sweeping brushes. A pair of drive pinions is provided for transferring rotary motion from the track belt pulleys to the brush drive, capable of alternately engaging that drive.

Motion of the pool cleaning tool along the swimming pool surface causes the displacement of the reciprocable bracket and selective engagement of one of the two drive pinions with the brush drive train, thereby ensuring that the rotary motion of the brushes always propels loose objects encountered along the surface toward the center of the vacuum chamber irrespective of the direction of movement of the tool.

Other features, objects and advantages of the combination pool cleaning tool of the invention will become apparent from the detailed description of the preferred embodiment thereof.

BRIEF DESCRIPTION OF THE ACCOMPANYING DRAWINGS

The preferred embodiment of the invention is illustrated in the accompanying drawings, wherein.

DESCRIPTION OF THE PREFERRED EMBODIMENT

Figure 1:
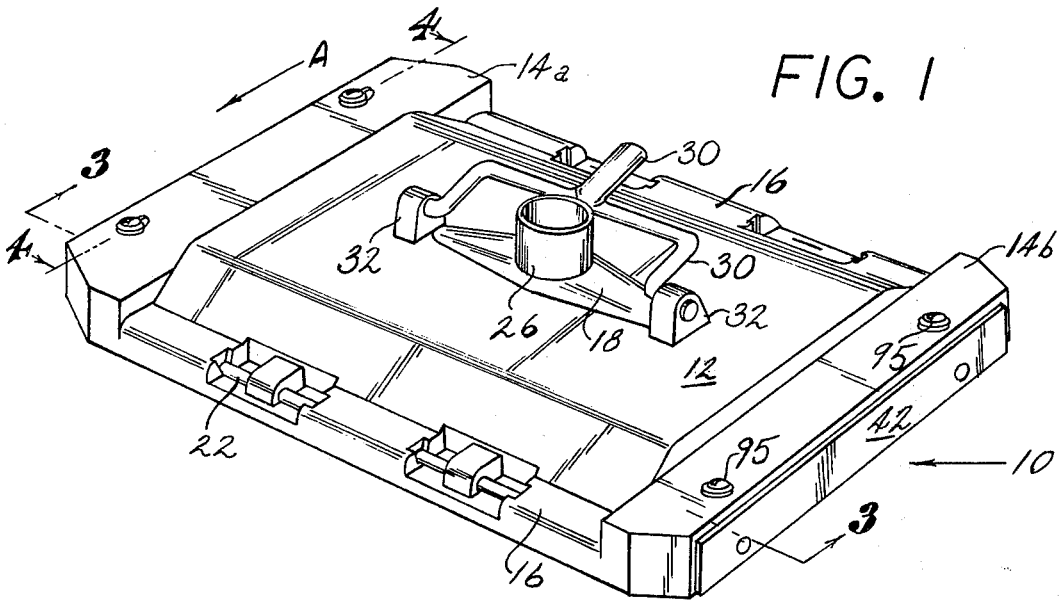
FIG. 1 is a perspective view of the combination pool sweeper and vacuum cleaner of the invention.

The perspective view of FIG. 1 shows a pool cleaning tool 10 with a central vacuum chamber housing 12, side skirts 14*a* and 14*b* and transverse aprons 16. A suction cone 18 is located centrally on the upper deck of chamber housing 12 and terminates in a cylindrical stub 26. The stub 26 is adapted to receive a flexible hose 28 through which pool water with entrained debris and sweepings is drawn to the pool filtering system (not shown) by a suitable pump (not shown).

A bail 30 is provided that is pivoted in bearing blocks 32 which blocks are integral with the housing 12. A handle (not shown) for the sake of clarity of description engages a bail 30 and is used to propel the pool cleaning tool 10 over the surface of a swimming pool in a desired direction.

The tool 10 may be moved in the direction of the arrow A, hereinafter referred to as the forward direction, or in a direction opposite thereto. Tool 10 is illustrated as movably supported by six rollers 20 mounted in aprons 16, and by track belts 40*a* and 40*b* movably mounted in the side skirts 14*a* and 14*b* respectively.

Figure 2:
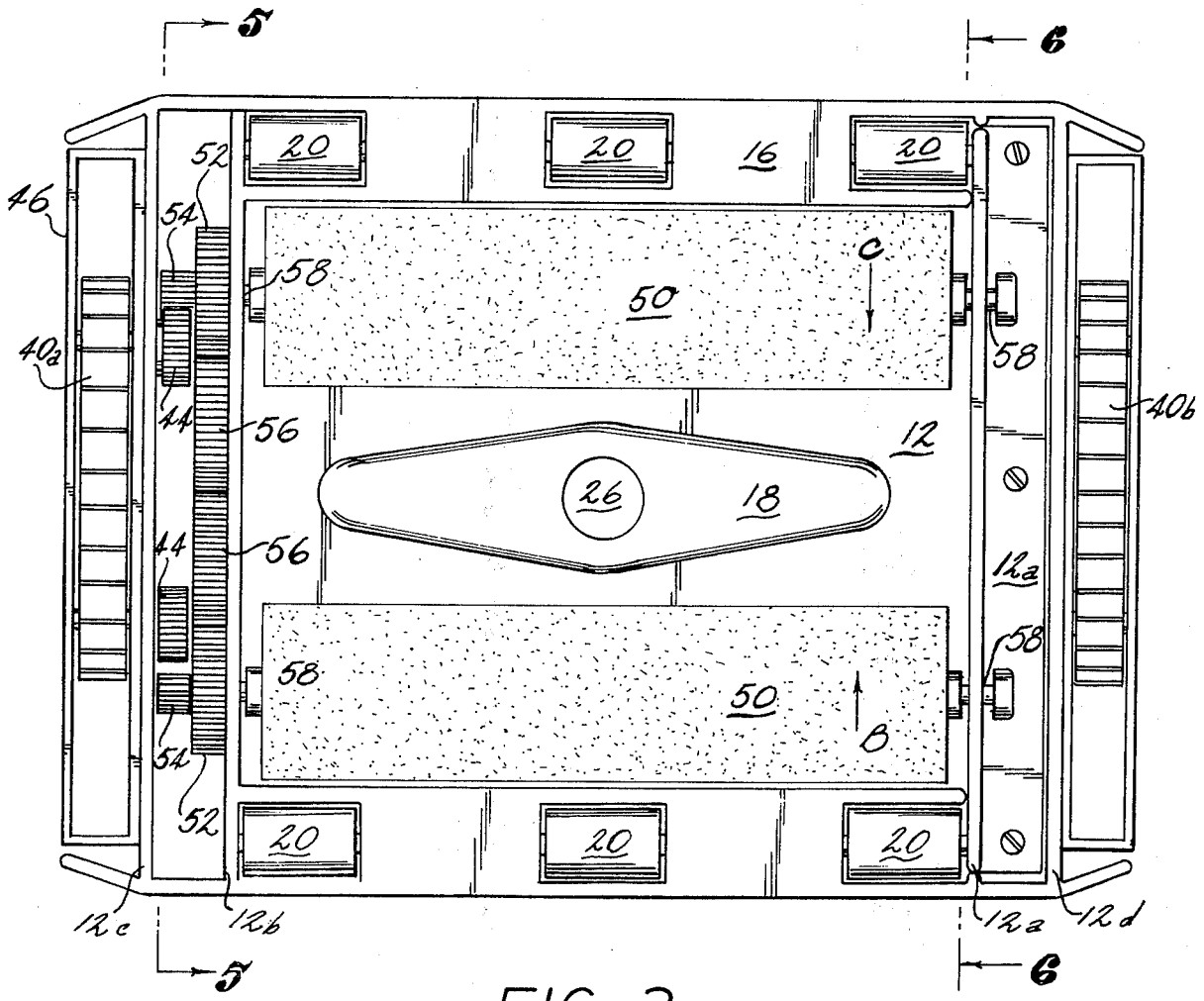
FIG. 2 is a bottom plan view of the embodiment of FIG. 1.
Figure 3:
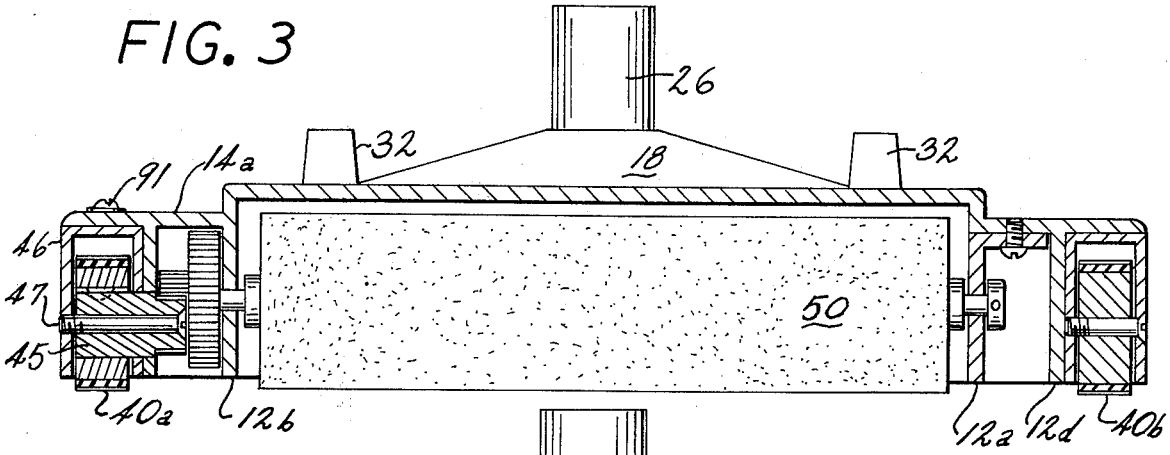
FIG. 3 is a transverse section of the combination tool, taken along section line 3—3 of FIG. 1.

The bottom plan view of FIG. 2 shows the alignment of the rollers 20 and belts 40*a* and 40*b*, and the transverse mounting of a pair of cylindrical rotary sweeping brushes 50 in the central cavity of the vacuum chamber housing 12. The brushes 50 are provided with shafts 58 which, in turn, are engaged in bearing orifices in a bracket plate 12*a* and partition plate 12*b*, which plates are integral with the housing 12 as shown in FIG. 3.

Figure 5:
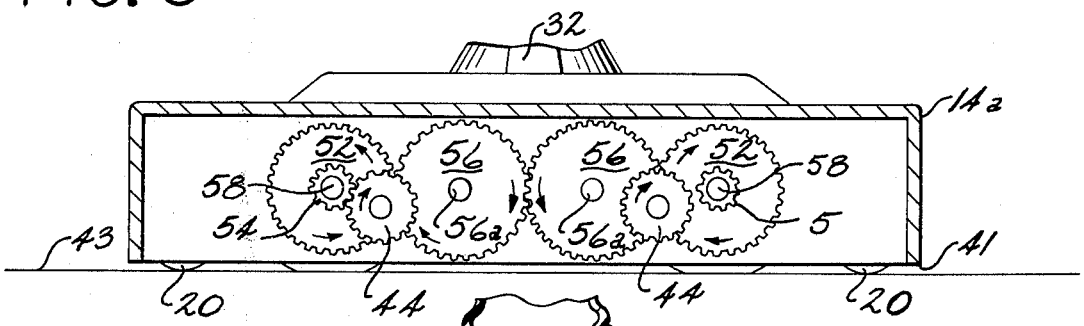
FIG. 5 is a cross sectional view of the invention taken on the line 5—5 of FIG. 2, illustrating the vacuum chamber of the combination tool.

The lower periphery of the housing 12, defined by aprons 16 and side plates 12*c* and 12*d*, is spaced from the pool surface by wheels 20 and belts 40 to create a gap 41 shown in FIG. 5 through which water may be drawn into the interior of housing 12 and, thence, through suction cone 18, stub 26 and hose 28, into the filter system of the pool.

The brushes 50 are so mounted that their lower surface is in substantial contact with the bottom 43 of the pool and propel any debris encountered thereon toward the suction cone 18. Counter-rotation of the brushes 50 is illustrated as being achieved by means of a drive train, including drive gears 52 and pinions 54, keyed in tandem to the shafts 58 outboard of the partition plate 12*b*. The drive gears 52 are interconnected by means of idler gears 56 mounted on pivot pins 56*a* affixed to the partition plate 12*b*. The gear train comprised of the gears 52 and idlers 56 which are in constant mesh ensures that the lower portions of brushes 50 rotate towards one another at the same velocity at all times. The gears 52 and idlers 56 are identical in each meshing pair, but the idlers are not necessarily of the same diameter as the drive gears.

Figure 4:
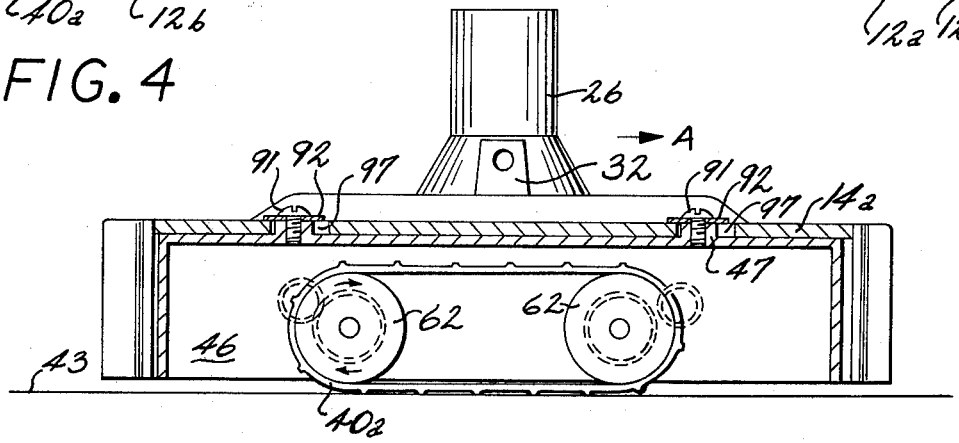
FIG. 4 is a longitudinal cross sectional view of the invention.

In FIG. 4 it will be seen that an idler channel 46 has a pair of idler pulleys 62 adjacently disposed thereto that support the track belt 40*a*. Keyed into the pulleys 62 are a pair of shafts whose inboard ends are machined into pinions 44 adapted to mesh with the pinions 54 of the brush drive. A central bore in each of the shafts 45 is engaged by a pin 47 secured to the idler channel 46 as shown in FIG. 3.

The idler channel 46 as may be seen in FIG. 4 is also provided with a pair of upwardly extending cylindrical bosses 47, in its otherwise planar upper surface, which bosses enter slots 97 in the side skirt 14*a*. The bosses 47 are reciprocable in the slots 97 and are retained therein by a pair of screws 91 and washers 92.

The spacing between the centers of idler pulleys 62 is smaller than the corresponding spacing between the centers of drive pinions 54 by a sufficient amount to permit the engagement of the forward drive pinion 54 by the forward track pinion 44, and the simultaneous disengagement of the rearward drive pinion from the rearward idler pinion, with the idler channel 46 in the foremost position in slots 97.

Figure 6:
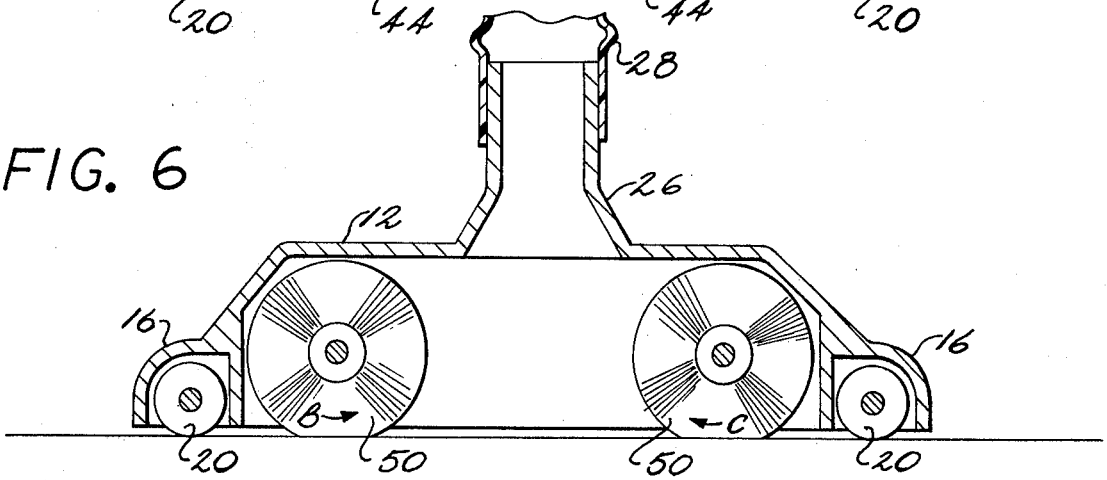
FIG. 6 is a cross sectional view of the invention taken on line 6—6 of FIG. 2.

When the tool 10 is propelled in a direction opposite to that of arrow A, the resistance to motion experienced by the track belt 40*a* impels the carrier 46 into a forward position in the slots 97. With the forward pinion pair 44/54 in mesh, the forward brush 50 is caused to turn in the direction of arrow C as seen in FIG. 6. This motion is, in turn, transmitted to the rear brush by idler gears 56 and impels it to rotate in the direction of arrow B, as seen in FIG. 6.

Motion of the assembly as shown in FIG. 1 in the direction of arrow A slides the carrier 46 into the rearmost sections of slots 97 and the drive of the brushes 50 is transmitted to the rearward pinion pair 44/54 with direction of rotation of the brushes 50 being that shown by arrows B and C in FIG. 6, as such rotation of the brushes 50 takes place any debris encountered is swept into the vacuum chamber housing 12.

Where the shaft 45 passes through partition plate 12*c*, parallel to and outwardly spaced from the partition plate 12*b*, a pair of slots accomodate its sliding motion and aid in guiding the idler channel 46 in its reciprocating path as the direction of movement of the pool cleaner is reversed.

On the opposite side of the cleaning tool 10 another idler channel 42 mounts a pair of idlers 64 over which a track belt 40*b* is stretched. The channel 42 is not reciprocable and is secured to side skirt 14*b* by screws 95.

FIGS. 4 and 5, show further details of the brushdrive train of the combination tool 10. It should be noted that the relative sizes of pinions 54 and 44 are so related to the effective diameters of the belt 40*a* and the brushes 50 that the peripheral velocity of the latter always exceeds the corresponding speed of the former, thereby providing a relative velocity between the tips of the brush bristles and the pool surface as the tool 10 is propelled thereover.

FIG. 6 illustrates the relative location of the two sweeping brushes 50 in the central cavity of the vacuum chamber housing 12 and the manner in which the gap 51 between the lower surface of the latter and the pool surface 43 is maintained by wheels 20.

The constructional materials of the combination tool of the invention are conventional in nature, taking into account the corrosive nature of the medium, swimming pool water with its high halide ion concentration, in which they must operate.

The major portions of the components of the invention are susceptible to being injection molded from a suitable commercially available polymerized resin. The preferred material for the track belts 40 is a natural or synthetic rubber, and a rubber composition is also suitable for the wheels 20.

The invention has been described with reference to its preferred embodiment; variations in shape, arrangement and mechanical detail of the several components are possible and may become apparent to one skilled in the art of constructing swimming pool cleaning equipment upon exposure to the teachings herein. Such variations shall be deemed within the scope of the invention, delimited only by the appended claims.

I claim:

1. In combination with a hollow housing having an open lower portion in communication with the interior of said housing, a pair of spaced parallel shafts rotatably supported in said housing, which shafts have a pair of elongate cylindrical sweeping brushes supported therefrom in parallel spaced alignment to contact and clean a surface over which said housing is moved, an assembly for concurrently driving said brushes whereby the surface contacting portions of said brushes move towards one another irrespective of the direction in which said housing moves over said surface, said assembly including:

a. supporting means, including a plurality of guide rollers, supporting said housing in a spaced relationship with respect to the inner surface of a pool;

b. a carrier reciprocable in said housing between a first position and a second position, along an axis parallel to said direction of motion; and c. drive means operatively associated with said supporting means and said pair of brushes for impelling said brushes into opposing rotational motion upon motion of said housing over said surface to discharge foreign material removed from said surface by said brushes into said interior of said housing, said drive means including:

1. a pair of drive gears, rigidly affixed to the shafts of said sweeping brushes, and a pair of idler gears interconnecting said pair of drive gears, rotatably mounted in said housing;

2. a pair of drive pinions, each one coaxial with one of said drive gears and rigidly keyed thereto; and

3. a pair of transfer pinions, each one coaxial with one of said idler pulleys and rigidly keyed thereto, whereby one of said transfer pinions is in mesh with one of said drive pinions in said first position of said carrier, and the other of said transfer pinions is in mesh with the other of said drive pinions in said second position of said carrier.

2. The combination tool defined in claim 1 wherein said supporting means further include:

with said direction of motion and in frictional contact with said pool surface, said assembly including a pair of pulleys rotatably mounted in said carrier and on which pulleys said endless belt is rotatably supported.

* * * * *